US007815750B2

(12) United States Patent
Okonogi et al.

(10) Patent No.: US 7,815,750 B2
(45) Date of Patent: Oct. 19, 2010

(54) METHOD OF PRODUCTION OF STEEL SOFT NITRIDED MACHINE PART

(75) Inventors: Makoto Okonogi, Muroran (JP); Kenichiro Naito, Tokyo (JP); Kohki Mizuno, Wako (JP); Hideki Matsuda, Wako (JP); Seiji Kobayashi, Wako (JP)

(73) Assignees: Nippon Steel Corporation, Tokyo (JP); Honda Motor Co., Ltd., Tokyo (JP)

( * ) Notice: Subject to any disclaimer, the term of this patent is extended or adjusted under 35 U.S.C. 154(b) by 261 days.

(21) Appl. No.: 11/605,026

(22) Filed: Nov. 27, 2006

(65) Prior Publication Data

US 2007/0119519 A1 May 31, 2007

(30) Foreign Application Priority Data

Nov. 28, 2005 (JP) ..... 2005-342582

(51) Int. Cl.
*C23C 8/26* (2006.01)
*C22C 38/46* (2006.01)

(52) U.S. Cl. ..... 148/226; 420/109

(58) Field of Classification Search ..... 148/226
See application file for complete search history.

(56) References Cited

U.S. PATENT DOCUMENTS 5,041,167 A 8/1991 Miwa

FOREIGN PATENT DOCUMENTS

JP 57-063628 * 4/1982
JP 11-62943 3/1999
JP 2001-131687 5/2001
JP 2002-226939 8/2002

OTHER PUBLICATIONS

English Translation of JP 57-063628.*
Office Action issued by the German Patent Office on Feb. 20, 2008 in connection with corresponding German Patent Application No. 10 2006 055 922.3.
Translation of the Office Action issued by the German Patent Office on Feb. 20, 2008 in connection with corresponding German Patent Application No. 10 2006 055 922.3.

* cited by examiner

*Primary Examiner*—Roy King
*Assistant Examiner*—Jessee R. Roe
(74) *Attorney, Agent, or Firm*—Kenyon & Kenyon LLP

(57) ABSTRACT

The present invention provides a method of production of a steel soft nitrided machine part comprising: preparing a steel material containing, by mass %, C: 0.15-0.30%, Si: 0.03-1.00%, Mn: 0.20-1.5%, S: 0.04-0.06%, Cr: 0.01-0.5%, Mo: 0.40-1.5%, Nb: 0.005-0.05%, Ti: 0.005-0.03%, V: 0.2-0.4%, Ni: 0.05-1.5%, N: 0.002-0.0048%, a balance of Fe and unavoidable impurities, limiting P to 0.02% or less, limiting Ceq. (equation (1)) to 0.65-0.85, controlling DI (equation (2)) to 80-155, log Kp (equation (3)) to 2.5-8, and Si and Mn contents according to equation (4), heating the steel material to 1150-1280° C., hot forging the steel material to the shape of the part, cooling the steel material at a 0.5-1.5° C/sec cooling rate to obtain a hot forged part having a micrometallic structure with more than 50% of bainite, machining the hot forged part, and soft nitriding the machined hot forged part at 550-650° C. for 30 minutes or more.

3 Claims, 2 Drawing Sheets

METHOD OF PRODUCTION OF STEEL SOFT NITRIDED MACHINE PART

BACKGROUND OF THE INVENTION

1. Field of the Invention

The present invention relates to a method of production of a steel soft nitrided machine part comprising hot forging a part, then cutting or otherwise machining it without thermal refining or normalization or other heat treatment, then soft nitriding it, in particular relates to a method of production of a steel soft nitrided machine part suitable for the production of a crankshaft or other machine part.

2. Description of the Related Art

In general, machine parts used in automobiles, industrial machinery, construction machinery, etc. are made by shaping S45C or other carbon steel materials for machine structures defined by JIS G4051 by hot forging, then thermal refining and normalizing or otherwise heat treating it, then cutting or otherwise machining it for finishing work. Further, among such machine parts, in particular crankshafts and other machine parts where a high fatigue strength and wear resistance are required are further soft nitrided, high frequency quenched, carburized, or otherwise heat treated for surface hardening in addition to the above treatment in the final process. Among these surface hardening treatments, soft nitridation has the advantage that the heating temperature is a low one of 600° C. or so and the heat treatment strain is small. However, soft nitridation gives a hardened layer of a shallow depth, so also has the problems of the small effect of improvement of the fatigue strength compared with the case of high frequency quenching or carburization. For this reason, a method of production of a steel soft nitrided machine part giving a machine part with a high fatigue strength is being sought.

Therefore, in the past, to cut costs and improve productivity, there has been proposed a steel material able to improve the fatigue strength and other mechanical properties and bending correctability or other workability even if omitting the thermal refining or normalizing after hot forging and even with soft nitridation (for example, see Japanese Patent Publication (A) No. 2002-226939, Japanese Patent Publication (A) No. 2001-131687, and Japanese Patent Publication (A) No. 11-62943). For example, the non-thermal refined steel for soft nitridation described in Japanese Patent Publication (A) No. 2002-226939 establishes suitable contents of C, Mn, Cr, s-Al, Ti, and O so as to improve the strength, nitridability, and fatigue strength and establishes a suitable relationship between the O content and the Ti content and the relationship between the O content and the N content so as to suppress growth of old austenite grains at the time of hot forging and improve the bending correctability.

Further, in the non-thermal refined soft nitrided steel parts of Japanese Patent Publication (A) No. 2001-131687, even if performing soft nitridation without thermal refining or normalization, a fatigue strength equal to or better than that of normalized steel is obtained by defining the contents of C, Si, Mn, P, Cr, Ti, V, N, Al, Pb, S, and Ca in the composition of the steel material before being worked and defining the ranges of the values of Fn1 to Fn3 found from the contents of C, Mn, and N. Further, Japanese Patent Publication (A) No. 11-62943 discloses a non-thermal refined crankshaft using a steel material of a composition establishing suitable contents of C, Si, Mn, Ti, Al, N, S, Ca, P, Cr, and V.

SUMMARY OF THE INVENTION

However, the conventional arts described in the above-mentioned Japanese Patent Publication (A) No. 2002-226939, Japanese Patent Publication (A) No. 2001-131687, and Japanese Patent Publication (A) No. 11-62943 only establish suitable compositions of the steel materials. Further, they consider not only the fatigue strength, but also the workability to machine parts etc. Therefore, there is the problem that an all important fatigue strength only equal to that of S45C to 48C carbon steel material for machine structures defined in JIS G4051 or 10 to 20% or so higher than these steel materials can be obtained.

The present invention was proposed in consideration of the above-mentioned problem points and has as its object the provision of a method of production of a steel soft nitrided machine part with a high fatigue strength by hot forging the part, machining it while omitting heat treatment, then soft nitriding it.

The method of production of a steel soft nitrided machine part according to the present invention comprises a step of preparing a steel material of a composition containing, by mass %, C: 0.15 to 0.30%, Si: 0.03 to 1.00%, Mn: 0.20 to 1.5%, S: 0.04 to 0.06%, Cr: 0.01 to 0.5%, Mo: 0.40 to 1.5%, Nb: 0.005 to 0.05%, Ti: 0.005 to 0.03%, V: 0.2 to 0.4%, Ni: 0.05 to 1.5%, N: 0.002 to 0.010%, and the balance of Fe and unavoidable impurities, limiting P to 0.02% or less in said unavoidable impurities, limiting a value of Ceq., defined by the following equation(1) where the C content (%) is indicated by [C], the Si content (%) by [Si], the Mn content (%) by [Mn], the P content (%) by [P], the S content (%) by [S], the Cr content (%) by [Cr], the Mo content (%) by [Mo], the V content (%) by [V], and the Ni content (%) by [Ni], to 0.65 to 0.85, having a value of DI, defined by the following equation (2), of 80 to 155, having a value of log Kp, defined by the following equation (3), of 2.5 to 8, and further having a relationship between the Si content and Mn content satisfying the following equation (4), heating this to 1150 to 1280° C., then hot forging the material to the shape of the part, and cooling it after forging by a 0.5 to 1.5° C./sec,cooling rate to obtain a hot forged part having a micrometallic structure in which a ratio of a bainite structure is 50% or more and a step of machining said hot forged part, then soft nitriding it under temperature conditions of 550 to 650° C. for 30 minutes or more.

$$Ceq. = [C] + \frac{1}{10} \times [Si] + \frac{2}{11} \times [Mn] + \frac{1}{5} \times [Cr] + \frac{1}{3}[V] + \frac{1}{6} \times \sqrt{[Mo]} \quad (1)$$

$$DI = 8.65 \times \sqrt{[C]} \times (1 + 0.64 \times [Si]) \times (1 + 4.10 \times [Mn]) \times (1 + 2.83 \times [P]) \times (1 - 0.62 \times [S]) \times (1 + 2.33 \times [Cr]) \times (1 + 0.52 \times [Ni]) \times (1 + 3.14 \times [Mo]) \quad (2)$$

$$\log Kp = 0.597 \times [C] - 0.100 \times [Si] + 1.395 \times [Mn] + 0.395 \times [Ni] + 1.295 \times [Cr] + 3.730 \times [Mo] - 0.869 \quad (3)$$

$$2.9 \times [Si] + [Mn] \geqq 2.0 \quad (4)$$

Further, another method of production of a steel soft nitrided machine part according to the present invention is characterized by having a step of preparing a steel material of a composition containing, by mass %, C: 0.15 to 0.30%, Si: 0.03 to 1.00%, Mn: 0.20 to 1.5%, S: 0.04 to 0.06%, Cr: 0.01 to 0.5%, Mo: 0.40 to 1.5%, Nb: 0.005 to 0.05%, Ti: 0.005 to 0.03%, V: 0.2 to 0.4%, Ni: 0.05 to 1.5%, N: 0.002 to 0.010%, Cu: 0.2 to 1.5%, and the balance of Fe and unavoidable impurities, limiting P among said unavoidable impurities to 0.02% or less, having a value of Ceq. defined by the following equation (5) when the C content (%) is indicated by [C], the Si content (%) by [Si], the Mn content (%) by [Mn], the P content (%) by [P], the S content (%) by [S], the Cr content (%) by [Cr], the Mo content (%) by [Mo], the V content (%) by [V], the Ni content (%) by (Ni), and the Cu content (%) by [Cu], of 0.65 to 0.85, having a value of DI defined by the following equation (6) of 80 to 155, having a value of log Kp defined by the following equation (7) of 2.5 to 8, and having a relationship between the Si content and the Mn content satisfying the following equation (8), heating it to 1150 to 1280° C., then hot forging the material to the shape of the part, and cooling it after forging by a 0.5 to 1.5° C./sec cooling rate to obtain a hot forged part having a micrometallic structure in which a ratio of a bainite structure is 50% or more and a step of machining said hot forged part, then soft nitriding it under temperature conditions of 550 to 650° C. for 30 minutes or more.

$$Ceq. = [C] + \frac{1}{10} \times [Si] + \frac{2}{11} \times [Mn] + \frac{1}{5} \times [Cr] + \frac{1}{3}[V] + \frac{1}{6} \times \sqrt{[Mo]} \quad (5)$$

$$DI = 8.65 \times \sqrt{[C]} \times (1 + 0.64 \times [Si]) \times (1 + 4.10 \times [Mn]) \times (1 + 2.83 \times [P]) \times (1 - 0.62 \times [S]) \times (1 + 2.33 \times [Cr]) \times (1 + 0.52 \times [Ni]) \times (1 + 3.14 \times [Mo]) \times (1 + 0.27 \times [Cu]) \quad (6)$$

$$\log Kp = 0.597 \times [C] - 0.100 \times [Si] + 1.395 \times [Mn] + 0.395 \times [Ni] + 1.295 \times [Cr] + 3.730 \times [Mo] + 0.398 \times [Cu] - 0.869 \quad (7)$$

$$2.9 \times [Si] + [Mn] \geqq 2.0 \quad (8)$$

In the present invention, since a steel material of a composition having a value of Ceq defined by the above equation (1), a DI value defined by the above equation (2), and a value of log Kp defined by the above equation (3) in the predetermined ranges and having an Si content and an Mn content satisfying the above equation (4) or a steel material of a composition having a value of Ceq. defined by the above equation (5), a DI value defined by the above equation (6), and a value of log Kp defined by the above equation (7) in the predetermined ranges and having an Si content and an Mn content satisfying the above equation (8) is used, even if omitting heat treatment after hot forging, superior mechanical properties and fatigue strength are obtained. Further, in the method of production of a steel soft nitrided machine part of the present invention, since not only the steel composition is optimized, but also the heating temperature before forging and the cooling rate after foring are optimized, the ratio of the bainite structure in the micrometallic structure of the hot forged part becomes 50% or more. Further, in the present invention, since the soft nitridation conditions are also optimized, a steel soft nitrided machine part with a higher fatigue strength compared with the conventional method of production is obtained.

According to the present invention, by optimizing the composition of the steel material and further by optimizing the heating temperature before forging and the cooling rate after forging, the ratio of the bainite structure in the micrometallic structure of the hot forged part is made 50% or more. Further, since the soft nitridation conditions are optimized, even if not performing the thermal refining and normalization or other heat treatment after the hot forging, a steel soft nitrided machine part provided with mechanical properties of an extent enabling cutting or other machining on the level of industrial production and having a high fatigue strength is obtained. As a result, not only can the performance of the steel soft nitrided machine part be raised, but also a reduction of the production costs and higher productivity can be enjoyed.

DESCRIPTION OF THE PREFERRED EMBODIMENT

Figure 1:
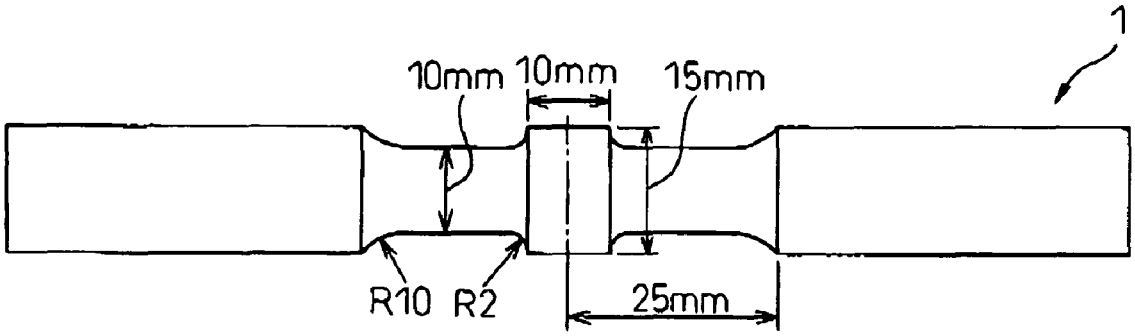
FIG. 1 is a viewing showing a shape of a rotational bending fatigue test piece of an example of the present invention.

Below, the best mode for working the present invention will be explained in detail. The inventors engated in in-depth studies to solve the above-mentioned problem points and as a result obtained the following discoveries. First, by making the micrometallic structure of the hot forged part before soft nitridation a mainly bainite structure and further soft nitriding this hot forged part under temperature conditions of 550 to 650° C., it is possible to improve the tensile strength and other mechanical properties. Second, by adding Nb, Ti, V, Cu, and other elements contributing to precipitation strengthening in combination to the chemical ingredients of the steel material, a precipitation strengthening phenomenon occurs in the soft nitridation under the above conditions, the mechanical properties are improved, and a machine part with a high fatigue strength is obtained.

Third, to enable a hot forged part not subjected to thermal refining and normalization or other heat treatment to be cut or otherwise machined on the level of industrial production, it is effective to make the value of Ceq. serving as an indicator of the carbon equivalent, the DI value serving as an indicator of the hardenability, and the value of Kp serving as an indicator of the critical cooling rate of pearlite, defined based on the contents of the ingredients of the steel material, suitable ranges. Fourth, when the relationship between the Si content and the Mn content satisfy specific conditions, specifically when the sum of 2.9 times the Si content and the Mn content is 2.0 or more, the fatigue strength after soft nitridation is remarkably improved.

The present invention was made based on the above discoveries and has as its gist heating a steel material to 1150 to 1280° C., then hot forging it to the shape of a part, cooling it after forging by a cooling rate of 0.5 to 1.5° C./sec to obtain a hot forged part with a micrometallic structure in which a ratio of the bainite structure is 50% or more and machining this hot forged part, then soft nitriding it under temperature conditions of 550 to 650° C. for 30 minutes or more.

Further, the steel material used in the present invention has a composition containing, by mass %, C: 0.15 to 0.30%, Si: 0.03 to 1.00%, Mn: 0.20 to 1.5%, S: 0.04 to 0.06%, Cr: 0.01 to 0.5%, Mo: 0.40 to 1.5%, Nb: 0.005 to 0.05%, Ti: 0.005 to 0.03%, V: 0.2 to 0.4%, Ni: 0.05 to 1.5%, N: 0.002 to 0.010%, and the balance of Fe and unavoidable impurities, limiting P in said unavoidable impurities to 0.02% or less, having a value of Ceq. defined by the following equation (9) of 0.65 to 0.85, having a value of DI defined by the following equation (10) of 80 to 155, having a value of log Kp defined by the following equation (11) of 2.5 to 8, and having a relationship between the Si content and Mn content satisfying the following equation (12). Note that in the following equations (9) to (12), [C] indicates the C content (%), [Si] indicates the Si content (%), [Mn] indicates the Mn content (%), [P] indicates the P content (%), [S] indicates the S content (%), [Cr] indicates the Cr content (%), [Mo] indicates the Mo content (%), [V] indicates the V content (%), and [Ni] indicates the Ni content (%).

$$Ceq. = [C] + \frac{1}{10} \times [Si] + \frac{2}{11} \times [Mn] + \frac{1}{5} \times [Cr] + \frac{1}{3}[V] + \frac{1}{6} \times \sqrt{[Mo]} \quad (9)$$

$$DI = 8.65 \times \sqrt{[C]} \times (1 + 0.64 \times [Si]) \times (1 + 4.10 \times [Mn]) \times (1 + 2.83 \times [P]) \times (1 - 0.62 \times [S]) \times (1 + 2.33 \times [Cr]) \times (1 + 0.52 \times [Ni]) \times (1 + 3.14 \times [Mo]) \quad (10)$$

$$\log Kp = 0.597 \times [C] - 0.100 \times [Si] + 1.395 \times [Mn] + 0.395 \times [Ni] + 1.295 \times [Cr] + 3.730 \times [Mo] - 0.869 \quad (11)$$

$$2.9 \times [Si] + [Mn] \geqq 2.0 \quad (12)$$

Below, the reasons for specifying the various factors in the above way in the method of production of a steel soft nitrided machine part of the present invention will be explained. Note that in the following explanation, the mass % showing the content of each ingredient included in the steel material just describes the %. First, the reasons for addition of the different elements and the reasons for the numerical limitations in the chemical composition of the steel material will be explained.

C: 0.15 to 0.30%

C is an element which raises the internal strength and precipitates as a carbide during soft nitridation to contribute to the precipitation strengthening. However, if the C content is less than 0.15 mass %, these effects cannot be obtained. On the other hand, if the C content is more than 0.30%, the hot forged part deteriorates in machineability. Accordingly, the C content is made 0.15 to 0.30%.

Si: 0.03 to 1.00%

Si acts as a deoxidizing agent at the time of refining the steel and further has the effect of contributing to the improvement of the hardenability of the steel material and raising the tempering softening resistance so as to improve the strength after soft nitridation. However, if the Si content is less than 0.03%, that effect cannot be obtained. On the other hand, if the Si content is more than 1.00%, the hot forged part deteriorates in machineability. Accordingly, the Si content is made 0.03 to 1.00%.

Mn: 0.20 to 1.5%

Mn is an element contributing to the improvement of the hardenability of the steel material and bainitization of the micrometallic structure of the hot forged part. However, if the Mn content is less than 0.20%, these effects cannot be obtained. On the other hand, if the Mn content is more than 1.5%, the hot forged part deteriorates in machineability. Accordingly, the Mn content is made 0.20 to 1.5%.

S: 0.04 to 0.06%

S has the effect of forming sulfides in the steel material and improving the cuttability. However, if the S content is less than 0.04, the effect cannot be obtained. On the other hand, if the S content is over 0.06%, improvement of the fatigue strength is obstructed. Accordingly, the S content is made 0.04 to 0.06%.

Cr: 0.01 to 0.5%

Cr is an element contributing to the improvement of the hardenability of the steel material and bainitization of the micrometallic structure of the hot forged part. However, if the Cr content is less than 0.01%, these effects cannot be obtained. On the other hand, if the Cr content is more than 0.5%, the hot forged part deteriorates in machineability. Accordingly, the Cr content is made 0.01 to 0.5%.

Mo: 0.40 to 1.5%

Mo is an element contributing to the improvement of the hardenability of the steel material and bainitization of the micrometallic structure of the hot forged part. Further, Mo has the effect of improving the strength after soft nitridation by precipitation strengthening to improve the fatigue strength of the steel soft nitrided machine part. However, if the Mo content is less than 0.40%, these effects cannot be obtained. On the other hand, if the Mo content is over 1.5%, the hot forged part deteriorates in machineability and the material costs become higher. Accordingly, the Mo content is made 0.40 to 1.5%.

Nb: 0.005 to 0.05%, Ti: 0.005 to 0.03%, V: 0.2 to 0.4%

Nb, Ti, and V are elements forming carbonitrides in the soft nitridation and contributing to precipitation strengthening. In particular, to improve the fatigue strength, it is effective to simultaneously add Nb, Ti, and V and cause the precipitation of composite carbonitrides in the steel material. However, if the Nb content is less than 0.005%, if the Ti content is less than 0.005%, or if the V content is less than 0.2%, these effects cannot be obtained. On the other hand, if the Nb content is over 0.05%, if the Ti content is over 0.03%, or if the V content is over 0.4%, the effect of addition becomes saturated and further the hot forged part deteriorates in machineability. Accordingly, the Nb content is made 0.005 to 0.05%, the Ti content 0.005 to 0.03%, and the V content 0.2 to 0.4%.

Ni: 0.05 to 1.5%

Ni is an element effective when bainitizing the micrometallic structure of the hot forged part. Further, Ni also has the effect of raising the strength of a steel soft nitrided machine part after soft nitridation and the effect of preventing hot roll scratches occurring due to addition of Cu. However, when the Ni content is 0.05% or more, these effects cannot be obtained. If the Ni content is over 1.5%, the hot forged part becomes too high in 5 strength and the cuttability falls. Accordingly, the Ni content is made 0.05 to 1.5%.

N: 0.002 to 0.010%

N has the effect of forming TiN, NbN, AlN, and other nitrides to make the crystal grains finer and improve the impact characteristic of the steel material. However, if the N content is less than 0.002%, a sufficient amount of nitrides are not formed and coarse grains are produced, so the steel material deteriorates in impact characteristic. Further, if the N content is over 0.010%, is the formation of carbides at the time of soft nitridation is inhibited and the precipitation strengthening characteristic deteriorates. Accordingly, the N content is made 0.002 to 0.010%.

P: 0.02% or less

P is an unavoidable impurity included in a steel material. If the P content exceeds 0.02%, the steel soft nitrided machine part drops in fatigue strength. Accordingly, the P content is limited to 0.02% or less.

In the present invention, to reliably convert the micrometallic structure of the hot forged part to bainite and to keep the hardness from increasing more than necessary and thereby secure the machineability, in addition to limiting the contents of the ingredients of the steel material to the above-mentioned ranges, the value of Ceq. defined by the above equation (9) and serving as an indicator of the carbon equivalent, the DI value defined by the above equation (10) and serving as an indicator of the hardenability, and the value of Kp defined by the above equation (11) and serving as an indicator of the critical cooling rate of pearlite are made the following ranges.

$0.65 \leqq Ceq. \leqq 0.85$

If the value of Ceq. defined by the above equation (9) is less than 0.65, the steel soft nitrided machine part drops in hardness and a high fatigue strength cannot be obtained. Further, if the value of Ceq. exceeds 0.85, the hot forged part increases too much in hardness and deteriorates in cuttability. Accordingly, the value of Ceq. is made 0.65 to 0.85.

$80 \leqq DI \leqq 155$

If the DI value defined by the above equation (10) is less than 80, the hardenability falls and making the structure of the hot forged part a bainite structure becomes difficult. Further, if the DI value exceeds 155, in the micrometallic structure of the hot forged part, the martensite structure becomes dominant and the cuttability deteriorates. Accordingly, the DI value is made 80 to 155.

$2.5 \leqq \text{Log } Kp \leqq 8$

If the value of log Kp defined by the above equation (11) is less than 2.5, pearlite is formed and the steel soft nitrided machine part after soft nitridation deteriorates in precipitation strengthening characteristic. Further, if the value of log Kp exceeds 8, the hot forged part increases too much in hardness and deteriorates in cuttability.

$2.9 \times [Si] + [Mn] \leqq 2.0$

The inventors discovered that among the factors affecting the fatigue strength of a steel soft nitrided machine part, in addition to the hardness, there are the Si content and Mn content of the steel material and, in particular, that the contents of these elements have large effects. Therefore, in the present invention, the Si content and Mn content of the steel material are made within the above-mentioned ranges and the relationship between the Si content and the Mn content is made to satisfy the above equation (12). Due to this, a steel soft nitrided machine part can be remarkably improved in the fatigue strength Further, in the present invention, it is possible to use a steel material containing, in addition to the above ingredients, Cu: 0.2 to 1.5%. In this case, when the Cu content (%) is (Cu), the value of Ceq. defined by the following equation (13) is made 0.65 to 0.85, the value of DI defined by the following equation (14) is made 80 to 155, and the value of log Kp defined by the following equation (15) is made 2.5 to 8 and the relationship between the Si content and Mn content is made to satisfy the following equation (16).

$$Ceq. = [C] + \frac{1}{10} \times [Si] + \frac{2}{11} \times [Mn] + \frac{1}{5} \times [Cr] + \frac{1}{3}[V] + \frac{1}{6} \times \sqrt{[Mo]} \quad (13)$$

$$DI = 8.65 \times \sqrt{[C]} \times (1 + 0.64 \times [Si]) \times (1 + 4.10 \times [Mn]) \times (1 + 2.83 \times [P]) \times (1 - 0.62 \times [S]) \times (1 + 2.33 \times [Cr]) \times (1 + 0.52 \times [Ni]) \times (1 + 3.14 \times [Mo]) \times (1 + 0.27 \times [Cu]) \quad (14)$$

$$\log Kp = 0.597 \times [C] - 0.100 \times [Si] + 1.395 \times [Mn] + 0.395 \times [Ni] + 1.295 \times [Cr] + 3.730 \times [Mo] + 0.398 \times [Cu] - 0.869 \quad (15)$$

$$2.9 \times [Si] + [Mn] \geqq 2.0 \quad (16)$$

Cu: 0.2 to 1.5%

Cu is an element which precipitates as Cu alone during soft nitridation and contributes to the precipitation strengthening of the steel material. However, if the Cu content is less than 0.2%, the effect of improvement of the fatigue strength of a steel soft nitrided machine part cannot be obtained, while if the Cu content exceeds 1.5%, hot embrittlement of the steel material is promoted. Accordingly, when adding Cu, the content is made 0.2 to 1.5%.

Note that the contents and reasons for numerical limitations of the elements other than Cu, the reasons for the numerical limitations of the value of Ceq. defined by the above equation (13), the value of DI defined by the above equation (14), and the value of log Kp defined by the above equation (15), and the reason for making the relationship between the Si content and the Mn content satisfy the above equation (16) are similar to the case of use of a steel material to which Cu is not added.

Next, the reasons for the numerical limitations of the different production conditions in a method of production of a steel soft nitrided machine part of the present invention will be explained.

Heating Temperature Before Forging: 1150 to 1280° C.

In the present invention, the steel material specifying the chemical composition in the above-mentioned ranges is heated to 1150 to 1280° C., then hot forging to a predetermined shape. Due to this, if a part of a general shape, it is possible to make the ratio of the bainite structure in the micrometallic structure of the hot forged part after forging 50% or more. On the other hand, if the heating temperature before forging is less than 1150° C., the deformation resistance at the time of hot forging becomes uneconomically high and coarse undissolved carbides remain, so at the time of soft nitridation, the amount of fine carbides acting for precipitation strengthening drops. Further, if the heating temperature before forging exceeds 1280° C., a hot embrittlement phenomenon is manifested and trouble such as cracks and flaws occur in the hot forged part. Accordingly, the heating temperature before hot forging is made 1150 to 1280° C.

Cooling Rate After Forging: 0.5 to 1.5° C./sec

When producing a particularly large part, if allowing it to naturally cool after forging, the cooling rate becomes slow. As a result, the micrometallic structure of the hot forged part ends up with a ratio of the bainite structure of 50% or more and the effect of improvement of the fatigue strength of the steel soft nitrided machine part sometimes cannot be sufficiently obtained. Specifically, if the cooling rate after hot forging is less than 0.5° C./sec, the micrometallic structure of the hot forged part ends up with a ratio of the bainite structure of less than 50% and the effect of improvement of the fatigue strength of the steel soft nitrided machine part drops. On the other hand, if the cooling rate after hot forging exceeds 1.5° C./sec, the hot forged part becomes higher in hardness and deteriorates in the cuttability. Accordingly, after hot forging, an air blast system etc. is installed to cool the part by a cooling rate of 0.5 to 1.5° C./sec. Due to this, the micrometallic structure of the hot forged part may be given a ratio of the bainite structure of 50% or more.

Ratio of Bainite Structure of Micrometallic Structure of Hot Forged Part: 50% or more If the micrometallic structure of the hot forged part before soft nitridation is not mainly bainite, the anticipated effect of improvement of the fatigue strength cannot be obtained. Specifically, if the micrometallic structure of the hot forged part has a ratio of the bainite structure of less than 50%, the effect of improvement of the fatigue strength of the steel soft nitrided machine part falls. For this reason, the ratio of the bainite structure in the micrometallic structure of the hot forged part before soft nitridation, that is, after forging, is made at least 50%. Note that by thermal refining or normalization of the part before soft nitridation, the micrometallic structure of the hot forged part may be made a similar structure and the effect of improvement of the fatigue strength of the steel soft nitrided machine part can be obtained, but in this case the production cost increases by the amount of performance of heat treatment.

Soft Nitridation Conditions: 550 to 650° C. for 30 minutes or more

Further, in the method of production of a steel soft nitrided machine part of the-present invention, the hot forged part prepared under the above conditions is machined to a predetermined shape, then soft nitrided under temperature conditions of 550 to 650° C. for 30 minutes or more. If the soft nitridation temperature is less than 550° C., the nitrided layer formed on the surface of the steel soft nitrided machine part becomes thin and a part with a high fatigue strength cannot be obtained. On the other hand, if the soft nitridation temperature exceeds 650° C., the advantage of the soft nitridation of a small heat treatment strain is lost. Further, when the soft nitridation time is less than 30 minutes as well, the nitrided layer formed on the surface of the steel soft nitrided machine part becomes thin and a part with a high fatigue strength cannot be obtained. Accordingly, the soft nitridation is performed under temperature conditions of 550 to 650° C. for 30 minutes or more.

As explained in detail above, in the method of production of a steel soft nitrided machine part of the present invention, the contents of the ingredients contained in the steel material used are optimized, the value of Ceq. serving as an indicator of the carbon equivalent, the DI value serving as an indicator of the hardenability, and the value of Kp serving as an indicator of the critical cooling temperature of pearlite formation are made optimal ranges, and the sum of 2.9 times the Si content and the Mn content is made 2.0 or more, so even if omitting heat treatment after hot forging, a steel soft nitrided machine part superior in mechanical properties and fatigue strength is obtained. Further, in the method of production of a steel soft nitrided machine part of the present invention, since not only the steel composition is optimized, but also the heating temperature before forging and the cooling rate after foring are defined, the ratio of the bainite structure in the micrometallic structure of the hot forged part becomes 50% or more. Further, since the soft nitridation conditions are also optimized, the effect of improvement of the fatigue strength of the steel soft nitrided machine part can be greatly increased compared with the conventional method.

EXAMPLES

Next, examples and comparative examples will be given to explain the effects of the present invention more specifically. In the examples of the invention, first, steel of each composition shown in the following Table 1 was prepared in a vacuum melting furnace, then hot rolled to prepare a hot rolled steel bar with a diameter of 90 mm. Next, each hot rolled steel bar was heated to the temperature shown in the following Table 2, then hot forged to a diameter of 50 mm and further cooled by a cooling rate shown in the following Table 2. At this time, the cooling rate was controlled utilizing an air blast system or heat insulating material. Further, each cooled hot forged part was observed for microstructure, then measured for the bainite ratio in the structure and Vicker's hardness. The bainite ratio was measured by observing the structure of 20 fields randomly selected from near the center of a rod with a diameter of 50 mm by an optical microscope and finding the area ratio (%) of the bainite structure. Further, the Vicker's hardness was measured using a micro-Vicker's hardness tester.

TABLE 1

| | Steel | Composition (mass %) | | | | | | | | | | | | | | | | | |
|---|---|---|---|---|---|---|---|---|---|---|---|---|---|---|---|---|---|---|---|
| | type | C | Si | Mn | P | S | Cr | Mo | Nb | Ti | V | Cu | Ni | N | Balance | Ceq. | DI | Kp | 2.9 × log [Si] + [Mn] |
| Ex. | A | 0.15 | 0.50 | 1.49 | 0.010 | 0.049 | 0.10 | 0.72 | 0.049 | 0.005 | 0.29 | — | 0.11 | 0.0033 | Fe and | 0.73 | 133 | 4.1 | 2.9 |
| | B | 0.16 | 1.00 | 0.60 | 0.009 | 0.049 | 0.06 | 1.49 | 0.005 | 0.009 | 0.26 | — | 0.31 | 0.0038 | unavoid- | 0.67 | 147 | 5.7 | 3.5 |
| | C | 0.19 | 0.71 | 0.79 | 0.009 | 0.050 | 0.11 | 1.01 | 0.022 | 0.019 | 0.21 | — | 0.20 | 0.0042 | able | 0.66 | 134 | 4.3 | 2.8 |
| | D | 0.21 | 0.99 | 0.99 | 0.010 | 0.051 | 0.05 | 0.79 | 0.025 | 0.021 | 0.32 | — | 0.20 | 0.0040 | impu- | 0.75 | 140 | 3.6 | 3.9 |
| | E | 0.25 | 0.61 | 0.44 | 0.011 | 0.050 | 0.10 | 0.99 | 0.031 | 0.011 | 0.29 | — | 0.29 | 0.0031 | rities | 0.67 | 98 | 3.8 | 2.2 |
| | F | 0.25 | 0.61 | 0.81 | 0.010 | 0.050 | 0.04 | 0.49 | 0.048 | 0.009 | 0.39 | 0.29 | 0.32 | 0.0048 | | 0.71 | 90 | 2.5 | 2.6 |
| | G | 0.29 | 0.35 | 0.99 | 0.010 | 0.050 | 0.33 | 0.41 | 0.042 | 0.023 | 0.20 | — | 0.10 | 0.0040 | | 0.74 | 122 | 2.6 | 2.0 |
| Comp. | H | 0.24 | 0.20 | 0.79 | 0.011 | 0.049 | 0.29 | 0.99 | — | — | — | — | 0.22 | 0.0044 | | 0.63 | 155 | 4.5 | 1.4 |
| ex. | I | 0.25 | 0.57 | 0.41 | 0.010 | 0.050 | 0.09 | 0.98 | — | — | 0.28 | — | 0.27 | 0.0032 | | 0.66 | 89 | 3.7 | 2.1 |
| | J | 0.25 | 0.56 | 0.42 | 0.008 | 0.051 | 0.10 | 1.00 | 0.033 | — | — | — | 0.28 | 0.0032 | | 0.57 | 93 | 3.8 | 2.0 |
| | K | 0.29 | 0.25 | 0.75 | 0.010 | 0.048 | 0.39 | 0.20 | — | — | — | — | — | 0.0048 | | 0.60 | 68 | 1.6 | 1.5 |
| | L | 0.48 | 0.19 | 0.79 | 0.010 | 0.050 | 0.51 | 0.35 | — | — | — | — | — | 0.0121 | | 0.84 | 130 | 2.5 | 1.3 |
| | M | 0.50 | 0.25 | 1.21 | 0.009 | 0.051 | 0.40 | 0.40 | — | — | 0.21 | — | — | 0.0068 | | 1.00 | 183 | 3.1 | 1.9 |
| | N | 0.51 | 0.10 | 1.21 | 0.010 | 0.050 | 1.42 | 1.49 | — | — | — | — | — | 0.0103 | | 1.23 | 955 | 8.5 | 1.5 |

TABLE 2

| | | | Hot forging | | Soft nitridation | |
|---|---|---|---|---|---|---|
| | | | Heating | | | |
| | No. | Steel type | temperature (° C.) | Cooling rate (° C./sec) | Temperature (° C.) | Time (min) |
| Example | 1 | A | 1260 | 0.7 | 600 | 120 |
| Example | 2 | B | 1260 | 0.7 | 600 | 120 |
| Example | 3 | C | 1260 | 0.7 | 600 | 120 |
| Example | 4 | D | 1260 | 0.7 | 600 | 120 |
| Example | 5 | E | 1260 | 0.7 | 600 | 120 |
| Comp. Ex. | 6 | E | 1100 | 0.7 | 600 | 120 |
| Comp. Ex. | 7 | E | 1310 | 0.7 | 600 | 120 |
| Comp. Ex. | 6 | E | 1260 | 0.7 | 500 | 120 |
| Comp. Ex. | 9 | E | 1260 | 0.7 | 700 | 120 |
| Comp. Ex. | 10 | E | 1260 | 0.7 | 600 | 10 |
| Comp. Ex. | 11 | E | 1260 | 0.1 | 600 | 120 |
| Comp. Ex. | 12 | E | 1260 | 2.1 | 600 | 120 |
| Example | 13 | F | 1260 | 0.7 | 600 | 120 |

TABLE 2-continued

| | | | Hot forging | | Soft nitridation | |
|---|---|---|---|---|---|---|
| | | | Heating | | | |
| | No. | Steel type | temperature (° C.) | Cooling rate (° C./sec) | Temperature (° C.) | Time (min) |
| Example | 14 | G | 1260 | 0.7 | 600 | 120 |
| Comp. Ex. | 15 | H | 1260 | 0.7 | 600 | 120 |
| Comp. Ex. | 16 | I | 1260 | 0.7 | 600 | 120 |
| Comp. Ex. | 17 | J | 1260 | 0.7 | 600 | 120 |
| Comp. Ex. | 16 | K | 1260 | 0.7 | 600 | 120 |
| Comp. Ex. | 19 | L | 1260 | 0.7 | 600 | 120 |
| Comp. Ex. | 20 | M | 1260 | 0.7 | 600 | 120 |
| Comp. Ex. | 21 | N | 1260 | 0.7 | 600 | 120 |

Next, each cooled hot rolled part was machined to prepare a rotational bending fatigue test piece of the shape shown in FIG. 1. This fatigue test piece was soft nitrided by the temperature and time shown in the above Table 2. At this time, the atmosphere in the soft nitridation furnace was made a mixed gas of $NH_3$; 50 vol %, $N_2$: 45 vol %, and CO: 2 vol %. Further, each soft nitrided sample was measured by a rotational bending fatigue test for the fatigue limit not breaking at $1\times10^7$ cycles (fatigue strength) $\sigma_w$ (MPa) and was measured for the Vicker's hardness. The above results are shown in the following Table 3. Note that the following Table 3 shows the difference between the hardness after soft nitridation and the hardness before the soft nitridation, that is, the precipitation strengthening ΔHV (=(hardness after soft nitridation)−(hardness of hot rolled part before soft nitridation)). Further, in the microstructures of the hot forged parts shown in the following Table 3, B indicates bainite, M martensite, F ferrite, and P pearlite.

TABLE 3

| | No. | Steel type | Structure | Bainite ratio (%) | Hot forged part hardness (HV) | Hardness after soft nitridation (HV) | Precipitation strengthening (ΔHV) | Fatigue strengthening $\sigma_w$ (MPa) |
|---|---|---|---|---|---|---|---|---|
| Example | 1 | A | B | 100 | 271 | 376 | 105 | 590 |
| Example | 2 | B | B + M | 95 | 298 | 402 | 104 | 640 |
| Example | 3 | C | B | 100 | 281 | 388 | 107 | 590 |
| Example | 4 | D | B | 100 | 291 | 413 | 122 | 670 |
| Example | 5 | E | B | 100 | 287 | 402 | 115 | 570 |
| Comp. Ex. | 6 | E | B + F | 80 | 296 | 361 | 65 | 520 |
| Comp. Ex. | 7 | E | B | 100 | 290 | 406 | 116 | 510 |
| Comp. Ex. | 8 | E | — | — | — | 335 | 48 | 500 |
| Comp. Ex. | 9 | E | — | — | — | 329 | 42 | 490 |
| Comp. Ex. | 10 | E | — | — | — | 353 | 66 | 500 |
| Comp. Ex. | 11 | E | B + F + P | 40 | 309 | 351 | 42 | 510 |
| Comp. Ex. | 12 | E | M + B | 20 | 412 | 442 | 30 | 590 |
| Example | 13 | F | F + B | 80 | 289 | 410 | 121 | 590 |
| Example | 14 | G | F + B | 95 | 275 | 383 | 108 | 550 |
| Comp. Ex. | 15 | H | M + B | 35 | 355 | 397 | 42 | 480 |
| Comp. Ex. | 16 | I | B | 100 | 268 | 351 | 63 | 510 |
| Comp. Ex. | 17 | J | B | 100 | 256 | 314 | 58 | 480 |
| Comp. Ex. | 18 | K | F + P | 0 | 213 | 247 | 34 | 380 |
| Comp. Ex. | 19 | L | B | 100 | 269 | 326 | 57 | 440 |
| Comp. Ex. | 20 | M | M + B | 20 | 427 | 380 | -47 | 510 |
| Comp. Ex. | 21 | N | M | 0 | 733 | 425 | -308 | 520 |

The samples of Example Nos. 1 to 5, No. 13, and No. 14 prepared in the range of the present invention had low hardnesses after hot forging. Even in the sample of Example No. 2 with the highest value, the HV was 298. As opposed to this, the samples of Comparative Example Nos. 20 and 21 where the C contents were outside the range of the present invention and further the Ceq. value and the DI value were outside the ranges of the present invention had high hardnesses after hot forging of HV427 and HV733 and concern over deterioration of the cuttability. Further, the sample of Comparative Example No. 12 where the cooling rate after hot forging was outside the range of the present invention also had a high hardness after hot forging of HV412 and a similar concern over deterioration of the cuttability.

Further, the samples of Example Nos. 1 to 5, No. 13, and No. 14 prepared in the range of the present invention all had high precipitation strengthening. Even the sample of Example No. 2 with the highest value, ΔHV was 104. As opposed to this, the samples of Comparative Example Nos. 15, 16, 17, 18, 19, 20, and 21 using steel types H, I, J, K, L, M, and N outside the ranges of ingredients of the present invention had remarkably lower precipitation strengthening compared with the samples of the examples of the invention. In particular, the samples of Comparative Example Nos. 15, 20, and 21 where the micrometallic structures after hot forging were mainly martensite structures were small in precipitation strengthening. Further, the present invention has simultaneous addition of Nb, Ti, and V as one of its features. The sample of Example No. 5 using a steel type where these elements were added in the ranges of the present invention had a precipitation strengthening ΔHV of 115, but the sample of Comparative Example No. 16 using steel type I where the contents of Nb and Ti were outside the ranges of the present invention and the sample of Comparative Example No. 17 using steel type J where the contents of Ti and V were outside the ranges of the present invention had contents of the other ingredients substantially the same as the sample of Example No. 15, but despite this had precipitation strengthenings of ΔHV63 and ΔHV58. From this, it is learned that simultaneous addition of Nb, Ti, and V was effective for precipitation strengthening.

Figure 2:
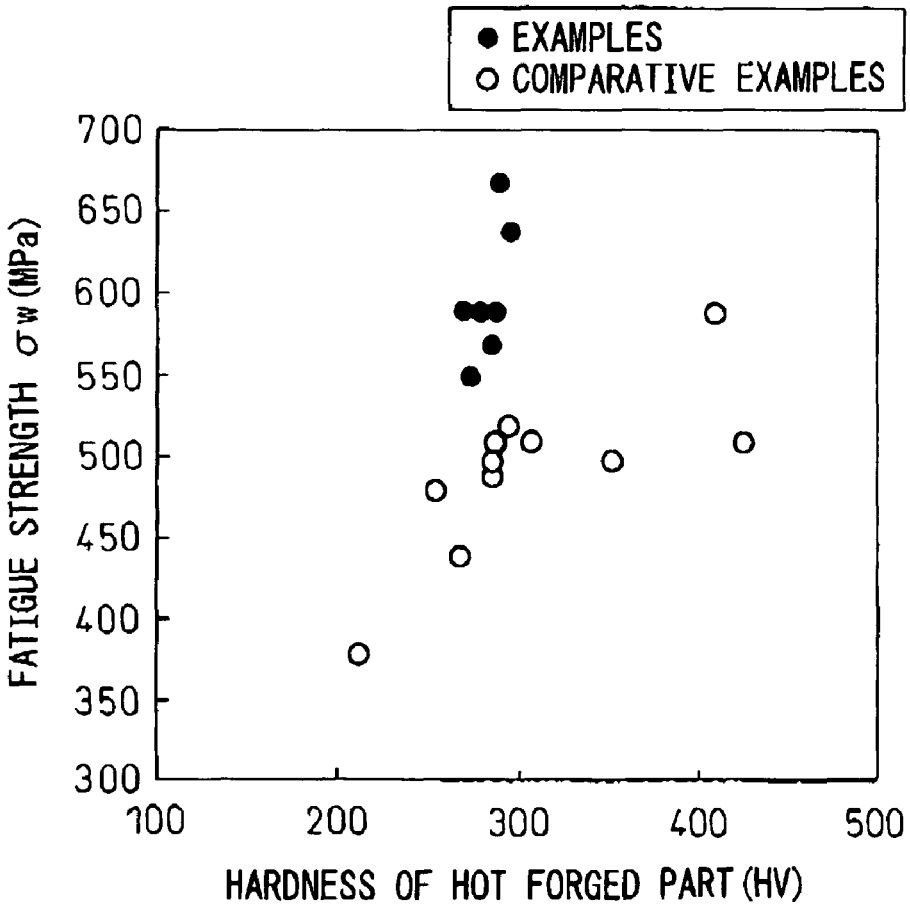
FIG. 2 is a graph showing the relationship between the hardness before soft nitridation and the fatigue strength after soft nitridation in samples of the examples and comparataive examples of the present invention plotting the hardness HV of the hot forged parts before soft nitridation on the abscissa and the fatigue strength $\sigma_w$ after soft nitridation on the ordinate.

Still further, the present invention raises the precipitation strengthening so as to give a hot forged part before soft nitridation which is soft and superior in cutting and other workability and to give a steel soft nitrided machine part after soft nitridation which has a high fatigue strength as one of its features. FIG. 2 is a graph showing the relationship between the hardness before soft nitridation and the fatigue strength after soft nitridation in examples of the present invention and comparative examples plotting the hardness HV of the hot forged parts before soft nitridation on the abscissa and the fatigue strength $\sigma_w$ after soft nitridation on the ordinate. As shown in FIG. 2, the samples of examples of the present invention were remarkably higher in fatigue strength $\sigma_w$ after soft nitridation compared with samples of comparative examples having similar hardnesses of hot forged parts before soft nitridation.

On the other hand, the sample of Example No. 5 having a heating temperature before hot forging within the range of the present invention had a precipitation strengthening of ΔHV115, but the sample of Comparative Example No. 6 having a heating temperature before hot forging less than the lower limit of the present invention had a precipitation strengthening of Δ65 or remarkably lower in precipitation strengthening compared with the sample of the above-mentioned Example No. 5. Further, the sample of Example No. 5 had a fatigue limit $\sigma_w$ of 570 MPa, but the sample of Comparative Example No. 7 having a heating temperature before hot forging exceeding the upper limit of the present invention had a fatigue limit $\sigma_w$ of 510 MPa or remarkably lower compared with the sample of Example No. 5. Further, the sample of Comparative Example No. 8 having a soft nitridation temperature less than the lower limit of the present invention, the sample of Comparative Example No. 9 having a soft nitridation temperature exceeding the upper limit of the present invention, and the sample of Comparative Example No. 10 having a soft nitridation time less than the lower limit of the present invention had precipitation strengthenings of ΔHV48, ΔHV42, and ΔHV66 and as a result fatigue limits $\sigma_w$ of 500 MPa, 490 MPa, and 500 MPa or remarkably inferior to the above-mentioned sample of Example No. 5. Still further, the sample of Comparative Example No. 11 having a cooling rate after hot forging less than the lower limit of the present invention formed a pearlite structure and ferrite structure and had a ratio of the bainite structure in the micrometallic structure of 40% or less than the lower limit of the present invention, so had a precipitation strengthening of ΔHV42 and a fatigue limit $\sigma_w$ of 510 MPa—both values lower than the sample of Example No. 5. Still further, the sample of Comparative Example No. 12 having a cooling rate after hot forging exceeding the upper limit of the present invention had a micrometallic structure of mainly martensite, so had a hardness after hot forging of a high HV412 and a concern over deterioration of the cuttability.

Figure 3:
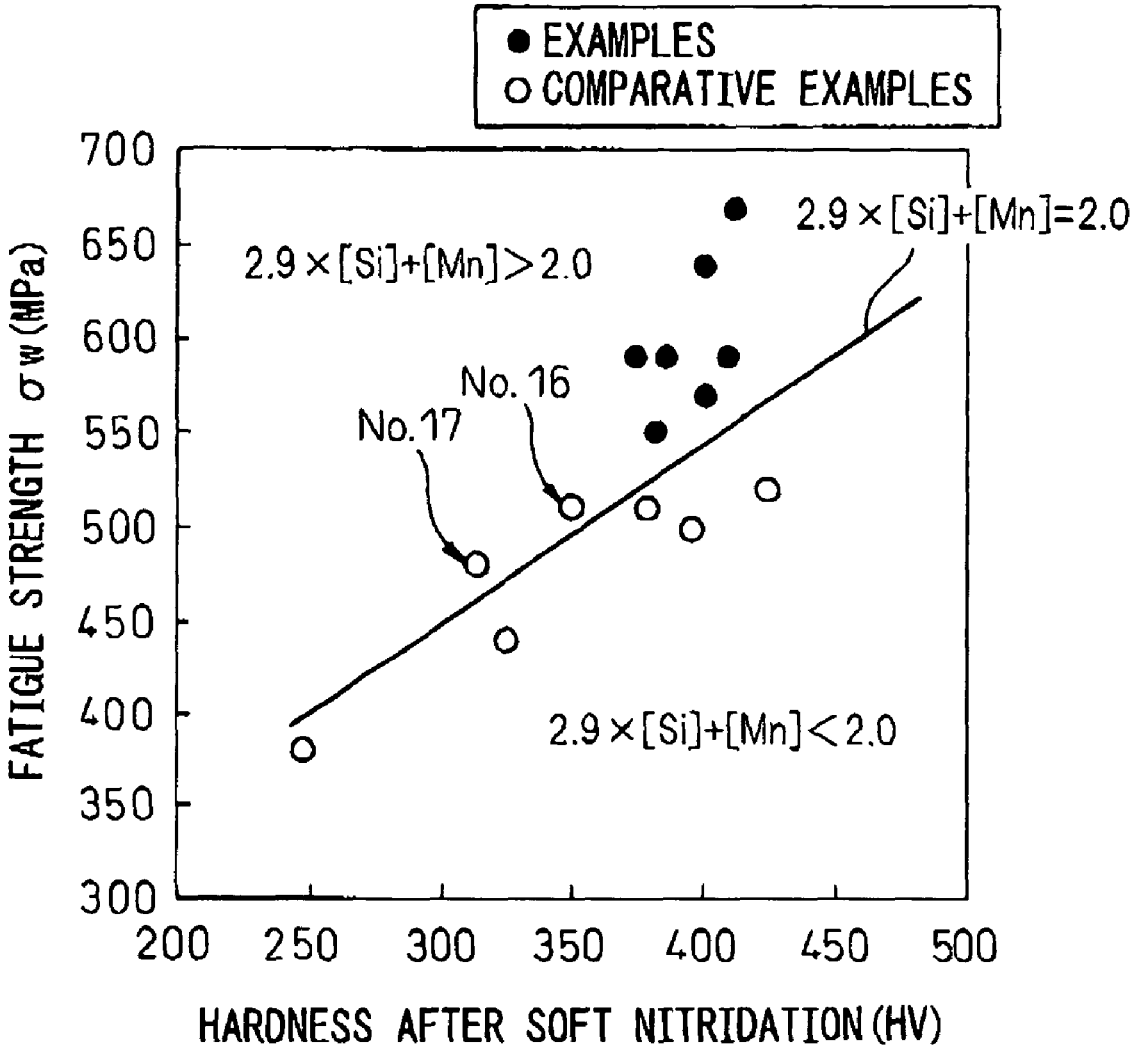
FIG. 3 is a graph showing the relationship between the hardness and fatigue strength after soft nitridation and the contents of Si and Mn in the steel material plotting the hardness after soft nitridation on the abscissa and the hardness and fatigue strength after soft nitridation and the contents of Si and Mn in the steel material after soft nitridation on the ordinate.

Still further, the method of production of a steel soft nitrided machine part according to the present invention has a composition of the steel material with a sum of 2.9 times the Si content and the Mn content of 2.0 or more as one of its features. FIG. 3 is a graph showing the relationship between the hardness and fatigue strength after soft nitridation and the contents of Si and Mn in the steel material plotting the hardness after soft nitridation on the abscissa and the hardness and fatigue strength after soft nitridation and the contents of Si and Mn in the steel material after soft nitridation on the ordinate. Note that the straight line shown in FIG. 3 shows the value when the sum of 2.9 times the Si content and the Mn content is 2.0. Further, the samples shown in FIG. 3 had the same forging conditions, cooling conditions, and soft nitridation conditions. As shown in FIG. 3, a correspondence is recognized between the hardness after soft nitridation and the fatigue limit. Samples using steel materials with a sum of 2.9 times the Si content and the Mn content of 2.0 or more had higher fatigue limits compared with samples using steel materials with a sum of 2.9 times the Si content and the Mn content of less than 2.0.

As explained above, according to the method of production of a steel soft nitrided machine part of the present invention, it was confirmed that a steel soft nitrided machine part having a high fatigue strength can be produced.

The invention claimed is:

1. A method of production of a steel soft nitrided machine part comprising the steps of:

preparing a steel material of a composition containing, by mass %, C: 0.15 to 0.30%, Si: 0.03 to 1.00%, Mn: 0.20 to 1.5%, S: 0.04 to 0.06%, Cr: 0.01 to 0.5%, Mo: 0.40 to 1.5%, Nb: 0.005 to 0.05%, Ti: 0.005 to 0.03%, V: 0.2 to 0.4%, Ni: 0.05 to 1.5%, N: 0.002to 0.0048%, and the balance of Fe and unavoidable impurities, limiting P to 0.02% or less in said unavoidable impurities, limiting a value of Ceq., defined by the following equation (1) where the C content (%) is indicated by [C], the Si content (%) by [Si], the Mn content (%) by [Mn], the P content (%) by [P], the S content (%) by [S], the Cr content (%) by [Cr], the Mo content (%) by [Mo], the V content (%) by [V], and the Ni content (%) by [Ni], to 0.65 to 0.85, having a value of DI, defined by the following equation (2), of 80 to 155, having a value of log Kp, defined by the following equation (3), of 2.5 to 8, and further having a relationship between the Si content and Mn content satisfying the following equation (4), heating this to 1150 to 1280° C., then hot forging the material to the shape of the part, and cooling it after forging by a 0.5 to 1.5° C./sec cooling rate to obtain a hot forged part having a micrometallic structure in which a ratio of a bainite base structure is more than 50%;

machining said hot forged part, then;

soft nitriding the machined hot forged part under temperature conditions of 550 to 650° C. for 30 minutes or more, $$Ceq. = [C] + \frac{1}{10} \times [Si] + \frac{2}{11} \times [Mn] + \frac{1}{5} \times [Cr] + \frac{1}{3}[V] + \frac{1}{6} \times \sqrt{[Mo]} \quad (1)$$

$$DI = 8.65 \times \sqrt{[C]} \times (1 + 0.64 \times [Si]) \times (1 + 4.10 \times [Mn]) \times (1 + 2.83 \times [P]) \times (1 - 0.62 \times [S]) \times (1 + 2.33 \times [Cr]) \times (1 + 0.52 \times [Ni]) \times (1 + 3.14 \times [Mo]) \quad (2)$$

$$\log Kp = 0.597 \times [C] - 0.100 \times [Si] + 1.395 \times [Mn] + 0.395 \times [Ni] + 1.295 \times [Cr] + 3.730 \times [Mo] - 0.869 \quad (3)$$

$$2.9 \times [Si] + [Mn] \geqq 2.0. \quad (4)$$

2. A method of production of a steel soft nitrided machine part comprising the steps of:

preparing a steel material of a composition containing, by mass %, C: 0.15 to 0.30%, Si 0.03 to 1.00%, Mn: 0.20 to 1.5%, S: 0.04 to 0.06%, Cr: 0.01 to 0.5%, Mo: 0.40 to 1.5%, Nb: 0.005 to 0.05%, Ti: 0.005 to 0.03%, V: 0.2 to 0.4%, Ni: 0.05 to 1.5%, N: 0.002to 0.0048%, Cu: 0.2 to 1.5%, and the balance of Fe and unavoidable impurities, limiting P among said unavoidable impurities to 0.02% or less, having a value of Ceq. defined by the following equation (5) when the C content (%) is indicated by [C], the Si content (%) by [Si], the Mn content (%) by [Mn], the P content (%) by [P], the S content (%) by [S], the Cr content (%) by [Cr], the Mo content (%) by [Mo], the V content (%) by [V], the Ni content (%) by [Ni], and the Cu content (%) by [Cu], of 0.65 to 0.85, having a value of DI defined by the following equation (6) of 80 to 155, having a value of log Kp defined by the following equation (7) of 2.5 to 8, and having a relationship between the Si content and the Mn content satisfying the following equation (8), heating it to 1150 to 1280° C., then hot forging the material to the shape of the part, and cooling it after forging by a 0.5 to 1.5° C./sec cooling rate to obtain a hot forged part having a micrometallic structure in which a ratio of a bainite base structure is more than 50%;

machining said hot forged part, then;

soft nitriding the machined hot forged part under temperature conditions of 550 to 650° C. for 30 minutes or more, $$Ceq. = [C] + \frac{1}{10} \times [Si] + \frac{2}{11} \times [Mn] + \frac{1}{5} \times [Cr] + \frac{1}{3}[V] + \frac{1}{6} \times \sqrt{[Mo]} \quad (5)$$

$$DI = 8.65 \times \sqrt{[C]} \times (1 + 0.64 \times [Si]) \times (1 + 4.10 \times [Mn]) \times (1 + 2.83 \times [P]) \times (1 - 0.62 \times [S]) \times (1 + 2.33 \times [Cr]) \times (1 + 0.52 \times [Ni]) \times (1 + 3.14 \times [Mo]) \times (1 + 0.27 \times [Cu]) \quad (6)$$

$$\log Kp = 0.597 \times [C] - 0.100 \times [Si] + 1.395 \times [Mn] + 0.395 \times [Ni] + 1.295 \times [Cr] + 3.730 \times [Mo] + 0.398 \times [Cu] - 0.869 \quad (7)$$

$$2.9 \times [Si] + [Mn] \geqq 2.0. \quad (8)$$

3. A method of production of a steel soft nitrided machine part according to claim 1 or 2, wherein the soft nitriding is carried out for obtaining precipitation strengthening of ΔHV of more than 80.

* * * * *